United States Patent [19]

Franks et al.

[11] 4,144,732

[45] Mar. 20, 1979

[54] METHOD AND APPARATUS FOR FORMING ONE-PIECE PULLEYS

[75] Inventors: Gerald M. Franks, Dearborn; John W. Haswell, Belleville, both of Mich.

[73] Assignee: Master Craft Engineering, Inc., Tifton, Ga.

[21] Appl. No.: 849,986

[22] Filed: Nov. 9, 1977

[51] Int. Cl.[2] ..... B21H 1/00

[52] U.S. Cl. ..... 72/84; 72/110; 113/116 D

[58] Field of Search ..... 72/84, 110, 111; 29/159 R; 113/116 B, 116 D

[56] References Cited

U.S. PATENT DOCUMENTS

| | | | |
|---|---|---|---|
| 3,831,414 | 8/1974 | Haswell et al. | 29/159 R |
| 3,852,863 | 12/1974 | Killian et al. | 113/116 D |

*Primary Examiner*—Lowell A. Larson

*Attorney, Agent, or Firm*—McNenny, Pearne, Gordon, Gail, Dickinson & Schiller

[57] ABSTRACT

An apparatus and method are provided for forming a pulley having at least two grooves from a cup-shaped metal blank having an axially extending sidewall. The blank is rotated about its longitudinal axis and is crushed between axially closing dies. As the blank is being crushed, a rough forming roll is translated radially into contact with the outer periphery of the cup and applies forming pressure at at least two axially spaced zones. A finish forming roll is radially aligned with the rough forming roll and is translated radially toward the outer periphery of the cup. The rough and finish forming rolls are carried by cam-actuated slide assemblies arranged to move the rough roll into the blank wall in advance of the finish roll in a working operation so as to partially form a pulley groove and to maintain the finish roll in the partially formed groove during an idling operation. Therefore, the rough roll is disengaged from the partially formed pulley groove and the finish roll is advanced to the root of the partially formed groove and into a working operation to form the finish groove. During the rough and finish rolling operations, the cup is unsupported interiorly at least in the area between adjacent pulley grooves.

7 Claims, 3 Drawing Figures

METHOD AND APPARATUS FOR FORMING ONE-PIECE PULLEYS

BACKGROUND OF THE INVENTION

This invention relates generally to the art of forming one-piece, multiple groove pulleys from cup-shaped pulley blanks. There are significant problems in manufacturing one-piece, single groove pulleys, and those problems are compounded in the manufacture of multiple groove pulleys. For example, in a double groove pulley, the grooves are separated by a land or circumferential rib located between the pulley grooves, and which is an outwardly directed bulge between those grooves. During the formation of the pulley, it was thought that that land must be unsupported by internal tooling within the cup, which serves as a backup as the pulley grooves are being formed. The tooling must be retracted from the land after the formation of the pulley grooves in order to permit removal of the completed pulley from the pulley making machine. It has been proposed that such tooling be a removable rubber ring in the case of double groove pulleys formed by segmented outer pulley groove forming dies (U.S. Pat. No. 3,124,090). Other such tooling may be a segmented and expandable inner die employed in a spinning operation (U.S. Pat. No. 2,892,431).

It has been found that when using an internal segmented die to back the land, the segmented die tends to stick in the groove after the crushing operation, since its retracting garter spring is not sufficiently strong to remove the segmented die from its wedged condition. This necessitates the hammering of the blank to free it from the die. A further disadvantage of the segmented internal die is the fact that many of those dies leave tooling marks on the pulley and provide a land which is not truly concentric.

As was stated above, the other type of internal tooling for forming the land between adjacent pulley grooves is a rubber block that will tend to expand into the land upon the application of axial pressure to the cup and which will return to a contracted position when the pressure is no longer applied. Although such rubber blocks do not tend to score the cup, they require frequent replacement, and tend to change their dimensions upon repeated machine cyclings.

An acceptable solution to the problem of supporting the land during a groove forming operation is found in U.S. Pat. No. 3,953,995. In that patent, there are provided techniques for forming a bulge in the sidewall of a cup-shaped blank while crushing the blank between axially closing dies. As the blank is being crushed, at least two rolls are translated radially into contact with the other surface of the blank sidewall while the blank is being rotated to form at least two annular pulley grooves in the sidewall of the blank. During the translation, a forming roll is positioned within the blank and is radially shifted away from the longitudinal axis of the cup and into contact with the inner sidewall to form a land between the pulley groove pairs.

Another example of the use of an internal forming roll is set forth in copending U.S. patent application Ser. No. 765,974, filed Feb. 7, 1977, now Pat. No. 4,055,977.

While an internal forming roll appears to be the ideal form of internal tooling, it involves precise cam timing. Another disadvantage of internal forming rolls is that as the cup is axially crused onto the internal roller, the internal roller tends to score the inner top surface of the cup since the inner roll has a smaller diameter than the cup itself, and is therefore traveling at a greater rate of speed.

SUMMARY OF THE INVENTION

This invention provides an apparatus for forming a multigroove pulley from a cup-shaped metal blank having a cylindrical sidewall. The apparatus overcomes the problem of internal tooling, since it has been found that such tooling is unnecessary so long as the axial extent of the sidewall of the cup equals or slightly exceeds the calculated length of sidewall metal sufficient to form the sidewall cross section.

The apparatus includes opposed, axially movable die members for applying axial pressure to the blank and rough and finish rollers for sequentially applying radially inwardly directed rolling pressure around the circumference of the cylindrical sidewall of the blank to form one or more pulley grooves connected by a land or land portions. The die members and rolls cooperate to form grooves having the desired root diameter connected to the land or lands and to outwardly flaring wall portions which are axially crushed together by the die members in their closed position to provide the pulley grooves with their ultimate cross sectional configuration.

The axially movable die members engage opposite ends of the cup and spin the cup about its axis. While the cup is spinning, the rough forming rolls are moved into engagement with the sidewall of the cup and begin to form at least two grooves in the sidewall thereof. As the rough forming rolls advance toward the axis of the cup, finish forming rolls are moved into the grooves being formed, but do not engage the sidewall of the cup, since the rough forming rolls are moved slightly in advance of the finish forming rolls so that the finish forming rolls are exposed within the partially formed grooves in an idling operation. At the completion of their working operation, the rough forming rolls are disengaged from the partially formed pulley grooves and the finish forming rolls are substantially simultaneously moved into a working operation with a negligible amount of nonworking, radial travel. The finish forming rolls are then continuously advanced to an imaginary circle having a diameter equal to the desired root diameter of the pulley grooves to cooperate with the axially movable die members at their final apposition to completely define the cross section of the pulley being formed.

The rough and finish forming operations are conducted without any mechanical backup, at least in the area of the lands between adjacent grooves. This feature not only eliminates the aforementioned problems of the removal of a mandrel from the land, but also eliminates problems of metal movement over an inner mandrel. In making a one-piece pulley, it is imperative that the metal be supplied to the groove being formed by the axially movable dies so that the cup is foreshortened to supply metal to the grooves being formed, rather than stretching the metal. At times the metal may not flow over the inner mandrel and will therefore tend to be stretched by a forming roller. In such instances, the metal may be dangerously thinned at the root of the groove, or the roller may cut through the metal during the forming operation.

The aforementioned forming rolls are carried by associated slide assemblies, which are cam-actuated to provide movement of the rough and finish forming rolls toward the longitudinal axis of the pulley blank. The camming actuation is provided by cam arms arranged for corresponding, parallel movement with the closing action of the axially movable die members. The slide assemblies are resiliently biased against the cam actuation, and upon completion of the camming movement, the assembly is returned to retracted, laterally spaced positions relative to the axially movable die members.

DETAILED DESCRIPTION OF THE INVENTION

Figure 1:
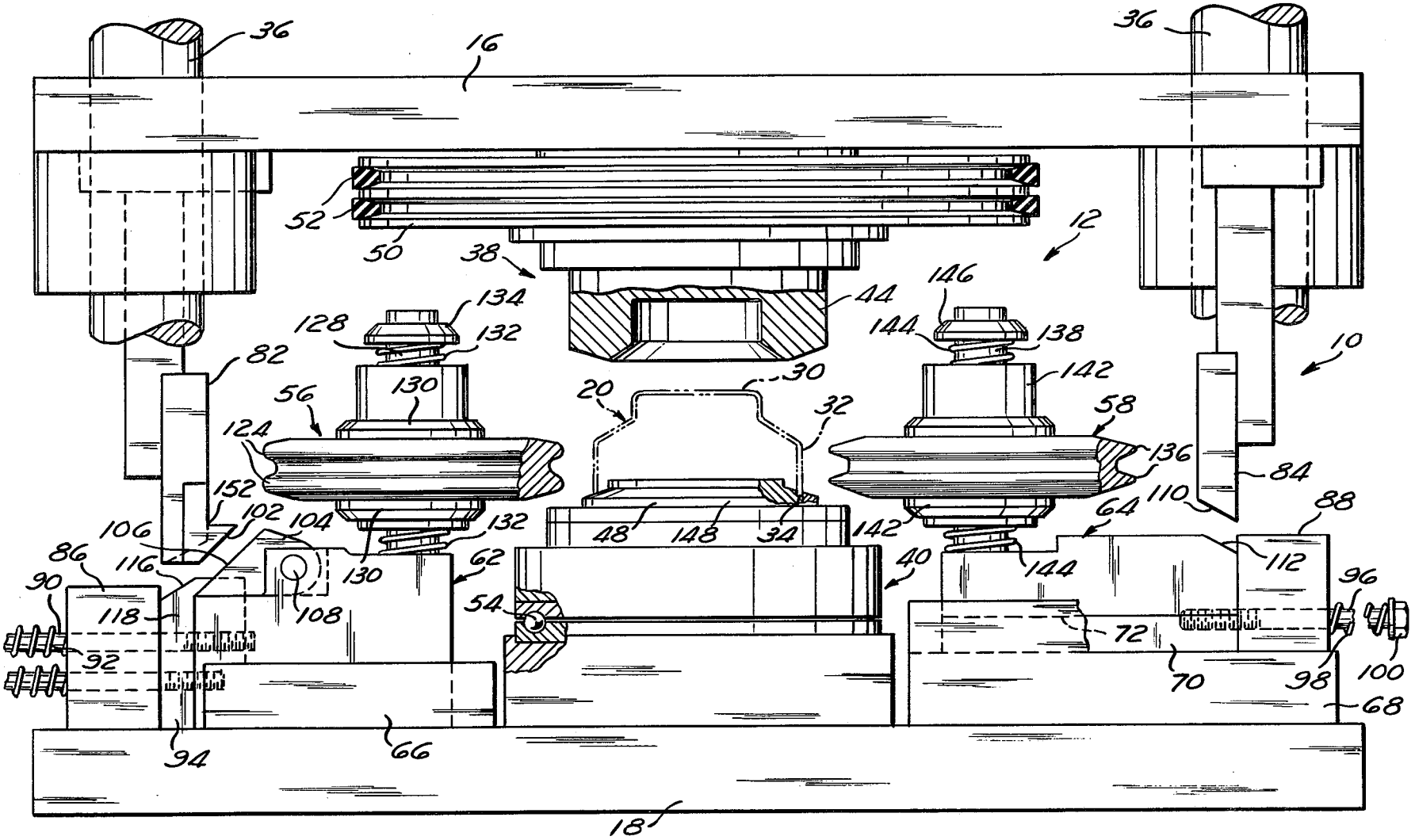
FIG. 1 is a front elevational view, partially in section, of a pulley forming apparatus according to the present invention.

Referring now to the drawings, and particularly to FIG. 1, a press 10 having a pulley forming apparatus 12 mounted therein is illustrated. The press 10 may be a conventional punch press including a ram plate or member 16 fixed to a ram (not shown), and a fixed lower bed or bolster plate or member 18. In FIG. 1, the press is shown in a particularly open position, with the ram plate 16 raised and a pulley blank 20 positioned within the pulley forming apparatus.

The pulley blank 20 is preformed and has a cup shape. The blank is formed of metal, and has a closed end 30, an axially extending cylindrical sidewall 32, and an opposed open end defined by the terminating edge 34 of the sidewall. The plate 16 is movable relative to the plate 18 and is guided in this movement by four corner posts 36 which slidably extend through the plate 16. The pulley forming apparatus further includes an axially movable member 38 and a member 40 which are respectively secured to the plate 16 and to the plate 18. The members 38 and 40 are arranged for axially closing movement upon advance of the ram plate 16 toward the plate 18 along the corner posts 36. Of course, either or both of the plates may be arranged for movement toward one another in order to close the members 38 and 40.

The members 38 and 40 are respectively provided with an upper die member 44 and a lower die member 48. Upon movement of the members 38 and 40 to their closed, final apposition, the die members 44 and 48 cooperate to define a die cavity corresponding to portions of the pulley to be formed.

The members 38 and 40 are axially aligned and mounted for rotation about their common longitudinal axis, which corresponds to the axis of the blank and the pulley to be formed. In addition, one or both (preferably one) of the members 38 and 40 may be arranged to be driven in order to establish rotative movement about the axis. As is illustrated, the member 38 is mounted in bearings and carries a double groove sheave 50 which is driven by a motor (not shown) through V-belts 52. The member 40 is mounted on bearings 54 and is rotated by the frictional transmission of torque by the blank during the pulley forming operation.

A rough roll forming member 56 and a finished roll forming member 58 are arranged to be simultaneously advanced at substantially right angles toward the longitudinal axis of the pulley blank, and to cooperate with the members 38 and 40 in the pulley forming operation. The roll forming members 56 and 58 are respectively mounted on slide assemblies 62 and 64. The assembly 62 slides on the base member 18 and is guided by ways 66. Similarly, the assembly 64 is mounted for sliding movement on a base plate 68, which is fixed to the base 18. The slide assembly 64 has laterally projecting flanges 70 which are received within slide panels 72 in the slide assembly. As is set forth in greater detail below, each of the slide assemblies is normally biased to a retracted position clear of the pulley blank, as shown in FIG. 1. The slide assemblies 62 and 64 are actuated by cam arms 82 and 84, which are rigidly secured to the ram plate member 16. The cam arms 82 and 84 cooperate with associated cam heel blocks 86 and 88, which provide laterally confining bearing surfaces for the cam arms. The cam heel blocks are secured to the base plate member 18 by means of bolts (not shown).

In addition to providing bearing surfaces for the associated cam arms, the heel blocks are also respectively employed in the biasing of the adjacent slide assembly to its retracted position. Specifically, the slide assembly 62 is threadedly engaged with bolts 90 which extend through the heel block 86 with clearance. The bolts 90 and the slide assembly 62 are resiliently biased to the left, as shown in FIG. 1, into a retracted position by means of springs 92 which are compressively retained between the bolt head (not shown) and the outward surface of the heel block. The retracted movement of the assembly is limited by its interlocking engagement with the guide block 66 and by a bumper 94 fixed to the assembly 62. The slide assembly 64 is similarly biased by bolts 96 and by compression springs 98 extending between the heel block 88 and the bolt heads 100.

The cam arm 82 includes a camming surface 102 arranged to work against a pivot arm 104 having a camming surface 106. As explained in greater detail below, the pivot arm 104 is connected to the assembly 62 by means of a mounting pin 108 and it is arranged to pivot in a clockwise direction, as shown in FIG. 1.

The cam arm 84 is similarly provided with a camming surface 110 arranged to work directly against a camming surface 112 of the slide assembly 64. The associated camming surfaces are arranged to uniformly drive the slide assemblies toward the longitudinal axis of the blank.

The rough forming roll 56 includes a pair of rolling surfaces 124 and the rough forming roll 56 is carried by a fixed shaft 128 extending from the slide assembly 62. The rough forming roll is mounted for rotation about the shaft 128 by means of bearing 130. The rough forming roll is also axially movable relative to the shaft and is resiliently biased to an unloaded position by means of compression springs 132 working between the bearings and the slide assembly 62 and between the bearings and an upper cap 134. Similarly, the finish roll includes a pair of finish rolling surfaces 136 and is mounted on a fixed shaft 138. The shaft 138 is fixed to the slide assembly 64. The finish roll 58 is mounted for rotation about the shaft 138 by means of bearings 142. The finish roll is axially movable relative to the shaft 138 and is resiliently biased to an unloaded position by means of compression springs 144, which extend between a bearing 142 and the slide assembly 64 and between a bearing 142 and an upper cap 146.

In a pulley forming operation a cup-shaped pulley blank 20 is positioned on the lower die member 48, as shown in FIG. 1. During the loading of the apparatus, the press is in its open position and the plate members 16 and 18, as well as the axially movable members 38 and 40, are spaced apart. Further, the slide assemblies 62 and 64 are biased to their laterally retracted positions by the springs 92 and 98.

A ring member 148 is associated with the lower die 48 and confines the lower edge of the cup during the working operation. After the cup has been loaded on the apparatus, one or both of the members 38 and 40 may be rotatably driven in order to establish relative rotation between the blank and the forming roll members.

In the initial stage of the pulley forming operation, the member 38 is brought into crushing engagement with the blank by the closing movement of the plate member 16. The slide assemblies 62 and 64 are advanced toward the blank by the camming action of their associated camming arms 82 and 84. As the member 38 is brought into engagement with the blank 20, the blank begins to rotate. The rough forming roll 56 is brought into engagement with the sidewalls of the cup and begins to form rough grooves in the sidewall as the cup is foreshortened by the crushing action of the members 38 and 40. It should be noted that during this stage of the pulley forming operation, a land 160 is only supported by internal tooling and is self-supporting, since the surfaces 124 are working against annular zones which are spaced on either side of the land 160.

Figure 2:
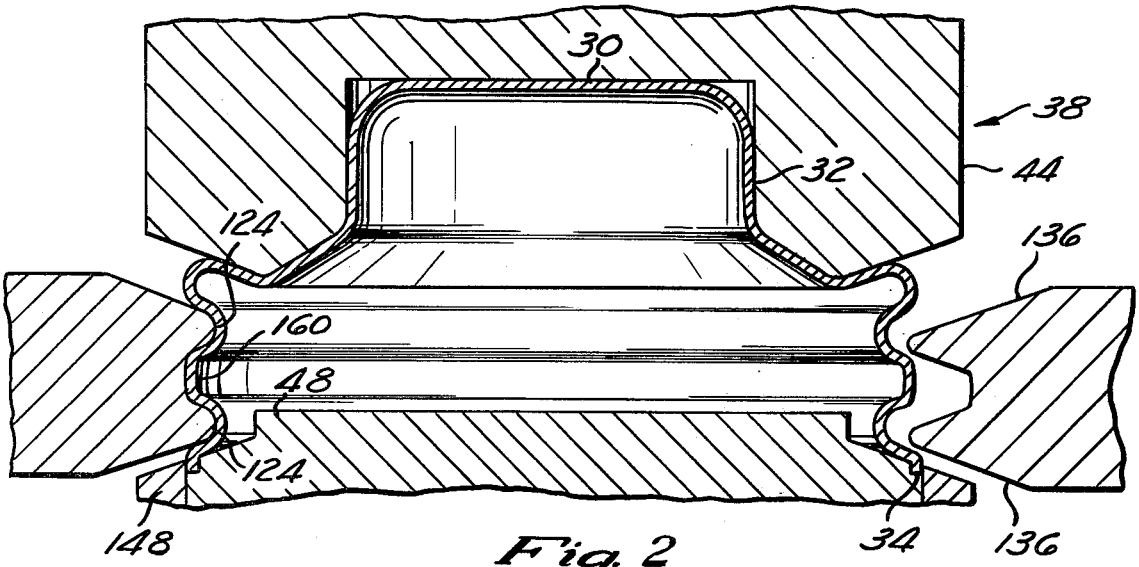
FIG. 2 is a fragmentary, front elevational view of a pulley forming apparatus illustrating the rough forming roll at the end of its working operation.

The rough roll 56 is moved towards the longitudinal axis of the blank slightly in advance of the finish roll 58, which, as may be seen in FIG. 2, is closely following the advance of the rough roller 56, but which at this stage is not touching the blank or performing a working operation. Accordingly, during the initial stages of the pulley forming operation, in which the pulley grooves are progressively formed, the finish rollers are positioned within the partially formed pulley groove in an idling but not working operation. The idling operation of the finish roll within the partially formed pulley groove expedites the pulley forming operation by subsequently maintaining the finish roll in a radially advanced and axially aligned position, ready to commence its working operation.

The rough roll may be moved in advance of the finish roll by simply arranging the cam arm 82 to initiate movement of the slide assembly 62 just prior to movement of the slide assembly 64. Alternatively, the retracted position of the slide assemblies 62 and 64 or relative diameters of the rolls 56 and 58 can be varied with appropriate adjustment of the respective cam-actuated movements thereof. Further, the cam angle of the finish roll drive may be arranged to initially move the finish roll at a slightly slower lateral advance rate than the rough roll and upon interchange at a slightly greater rate.

Figure 3:
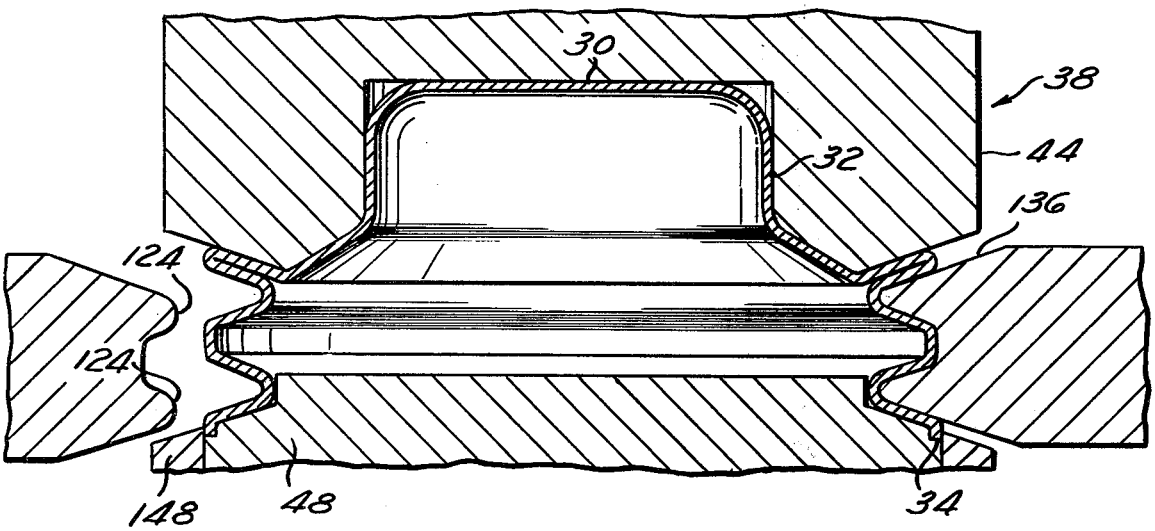
FIG. 3 is a fragmentary, front elevational view of the pulley forming apparatus illustrating the finish forming roll at the end of its working operation.

In FIG. 2, the rough roll 56 has reached the extent of its radial travel and is about to be retracted to a non-working position, as illustrated in FIGS. 1 and 3. Retraction of the roll 56 obtains when the cam surface 102 slides off the cam surface 106 and passes beneath the pivot arm so that the pivot arm is retracted into a notch 152 in the cam arm 82. Further downward movement of the member 38 forces the finish roll into working engagement with the pulley grooves to finally form the pulley to the shape illustrated in FIG. 3. While the blank is not backed up by any internal tooling during the finish forming operation, the sidewalls of the grooves tend to conform to the periphery of the finish roll. The reasons for this occurrence are not completely understood, but it is believed that when a blank is spun at high speed, only those zones to which a lateral force is applied will tend to deform, while zones that receive no forces remain in their original position. After completion of the pulley forming operation, the upper plate member 16 is raised to permit the roll 58 to return to its position illustrated in FIG. 1. Upon upward movement of the member 16, the pivot arm 104 is caused to pivot about its pin 108 and then when the cam arm 82 is cleared, the pivot arm 104 falls by gravity to the position illustrated in FIG. 1.

The invention is not restricted to the slavish imitation of each and every detail set forth above. Obviously, devices may be provided which change, eliminate, or add certain specific details without departing from the scope of the invention.

What is claimed is:

1. A machine for forming a pulley having a plurality of pulley grooves of given cross section from a pulley blank in the form of a cup, each groove being defined by pulley wall means connected to the root of the groove and each groove being separated from an adjacent groove by a land, comprising axially movable members for engaging said blank adjacent opposed axial ends thereof, means to axially advance at least one of said axially movable members toward the other to a final apposition at which they define a portion of a die cavity, roll die means including at least one forming roll translatable toward the longitudinal axis and outer sidewall of the cup, said forming roll having a periphery adapted to roll form the periphery to a desired configuration, supporting means on one of said axially movable members to support the open mouth of the cup during the forming operation, the interior of said cup being unsupported by mandrel means at east at said land during all stages of the forming operation.

2. A machine for forming a pulley according to claim 1, wherein said roll die means includes a rough forming roll and a finish forming roll.

3. A machine for forming a pulley according to claim 2, wherein said rough roll and said finish roll have pairs of spaced projecting V-shaped peripheries.

4. A machine for forming a pulley according to claim 2, wherein roll die translating means are provided and wherein said roll die translating means are movable in response to movement of said axially movable members toward and away from each other.

5. A machine for forming a pulley according to claim 4, wherein said axially movable members are fixed to and movable with upper and lower platens and wherein said roll die translating means comprise first and second slide members respectively fixed to said rough roll and said finish roll and slidable along said lower platen, a cam member fixed to each slide member and cooperating with cam members fixed to the upper platen and adapted to engage the cam members fixed to the slide members to translate said rough roll and said finish roll.

6. A method for forming a pulley having a plurality of pulley grooves of given cross section from a pulley blank in the form of a cup, each groove being defined by pulley wall means connected through the root of the groove and each groove being separated from an adjacent groove by a land, comprising the steps of providing a cup-shaped pulley blank, axially crushing the blank and while crushing the blank applying pressure at a plurality of axially spaced annular zones on said blank to form said grooves, said pressure being unopposed at least in an area between said axially spaced annular zones during all stages of the forming operation.

7. A method for forming a pulley according to claim 6, wherein said pressure is a circumferential rolling pressure.

* * * * *